US006533639B1

(12) United States Patent
Tammara

(10) Patent No.: US 6,533,639 B1
(45) Date of Patent: Mar. 18, 2003

(54) TOY CARGO TRANSFER APPARATUS

(76) Inventor: Robert F. Tammara, 7081 Auburn Mill Rd., Warrenton, VA (US) 20187

( * ) Notice: Subject to any disclaimer, the term of this patent is extended or adjusted under 35 U.S.C. 154(b) by 0 days.

(21) Appl. No.: 09/722,233

(22) Filed: Nov. 27, 2000

(51) Int. Cl.[7] ..... A63H 11/00; A63H 29/00
(52) U.S. Cl. ..... 446/332; 446/359; 446/476
(58) Field of Search ..... 446/134, 135, 446/136, 330, 332, 335, 353, 82, 83, 476, 364, 359

(56) References Cited

U.S. PATENT DOCUMENTS 311,220 A * 1/1885 Anderson ..... 446/332
885,350 A * 4/1908 Lehy ..... 446/332
959,638 A * 5/1910 Stafford ..... 446/332
1,704,012 A * 3/1929 Marx ..... 446/332
1,874,087 A * 8/1932 Diederichs ..... 446/332
2,157,397 A * 5/1939 Brink

* cited by examiner

*Primary Examiner*—Jacob K. Ackun
(74) *Attorney, Agent, or Firm*—Edward Goldberg

(57) ABSTRACT

Toy figures carry cargo items from one building to another and return without the items to appear to have unloaded the items. This is achieved with an electric motor driving gears connected to two parallel belts moving in opposite directions between the buildings at opposite ends of a platform. Duplicate figures are secured on each belt with one set of figures moving in one direction carrying items and the other set moving in the other direction not carrying items. Figures on the upper surfaces of the belts rotate about roller supports at the ends and are returned inverted along the lower belt surfaces. The belt ends and lower surfaces are obscured by the end buildings and side walls so that only the figures on the upper belts are seen moving in opposite directions with and without loads to provide the desired illusion.

7 Claims, 4 Drawing Sheets

TOY CARGO TRANSFER APPARATUS

BACKGROUND OF THE INVENTION

1. Field of the Invention

The present invention relates to a toy cargo transfer mechanism and particularly to a device which simulates the movement of miniature figures on parallel belts traveling in opposite directions. The figures appear to carry cargo in one direction from one building to another and then return empty handed to appear to have unloaded the cargo.

2. Description of the Prior Art

U.S. Pat. No. 311,220 to Anderson utilizes a plurality of endless parallel belts with toy figures secured thereon which appear to walk along a platform. The belts all move in the same direction around rollers at opposite ends. The upper belt surfaces and figures are visible while the lower belts returning the figures to the initial end are blocked from view.

U.S. Pat. No. 885,350 to Lehy utilizes an endless drive belt or sprocket chain mechanism between opposite ends of a horizontal platform to engage and move two other endless belts in rectangular paths along the platform. Figures secured to the two belts move around a simulated shop window display. The figures remain visible and all move around the rectangular paths in the same direction.

U.S. Pat. No. 959,638 to Stafford utilizes two endless belts with visible figures on the upper surfaces and hidden figures on the lower surfaces which rotate around sprocket wheels to the upper path. The belts all move in the same direction with two sets of figures moving into and out of opposite ends of a building.

U.S. Pat. No. 1,704,012 to Marx utilizes a single belt driven in one direction around a long horizontal path to simulate a parade. Objects and figures are secured on the belt at spaced positions and enter and exit a building at one end and then move along a continuous path to enter and exit a building at the opposite end.

These mechanisms have not been able to provide the unique appearance of having figures moving along a path in one direction carrying a load or cargo and then returning in the other direction without the cargo to simulate the unloading of the cargo.

SUMMARY OF THE INVENTION

It is therefore the primary object of the invention to provide a toy cargo transfer apparatus which simulates figures carrying and unloading cargo items.

It is another object of the invention to provide a simple mechanism which moves figures carrying items along a path in one direction and returns figures in the opposite direction without the items.

A further object of the invention is to provide a pair of twin parallel belts continuously moving in opposite directions with visible figures traveling in one direction carrying load items and like figures traveling in the other direction with no items being carried.

An additional object is to provide building structures at each end of a pair of oppositely moving belts so that figures exiting a building at one end carry items toward and enter the other structure with the items but return in the opposite direction empty handed to appear to have unloaded the items.

It is also an object of the invention to provide a pair of twin parallel oppositely moving belts which support figures carrying loads in one direction and appear to return in the other direction without loads, each set of figures being visible on the upper surface of each belt but actually returning along the lower surface of the same belt which is hidden by walls and building structures.

These objects are achieved with a unique structure and mechanism including an electric motor driving gears linked to two parallel belts supported along a platform and moving in opposite directions. Duplicate figures are secured along each belt, with the visible figures moving in one direction on the upper belt surfaces carrying items while the like figures moving in the other direction are not carrying items. Building structures at each end and walls therebetween obstruct the view of the ends and lower portions of the belts. The figures rotate around the ends of the belt with the inverted invisible figures being returned along the lower belt back to the other end in a continuous movement. This results in the appearance of the figures carrying items entering a building at one end and then returning in the opposite direction without the items to provide the illusion that the items have been unloaded.

Other objects and advantages will become apparent from the following description in conjunction with the accompanying drawings.

DESCRIPTION OF THE PREFERRED EMBODIMENT

Figure 1:
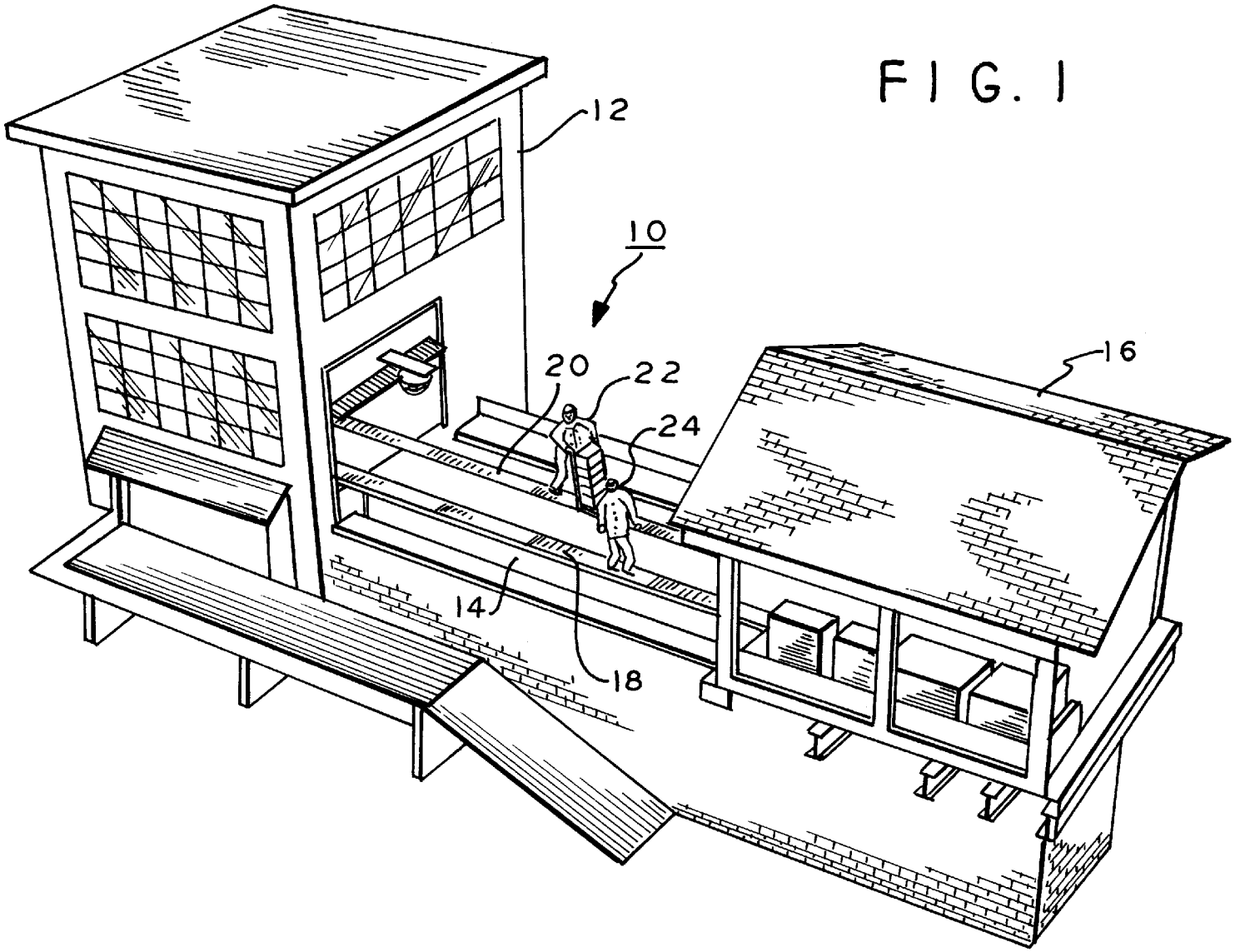
FIG. 1 is a side angled view of the overall apparatus from above showing figures mounted along parallel belts moving in opposite directions between structures at each end.

As shown in FIG. 1, a building structure 10, which is utilized as a loading dock for storing and transferring cargo items in connection with toy railroad trains, includes a main building 12, a work platform or deck 14 and a storage shed 16 at the end of the platform. A pair of like motor driven parallel belts 18, 20 are positioned along the platform connecting building 12 and shed 16 to facilitate transfer of cargo therebetween. Miniature figures of workmen 22, 24 are secured to the belts to carry cargo items to the shed and then return to the building.

Figure 2:
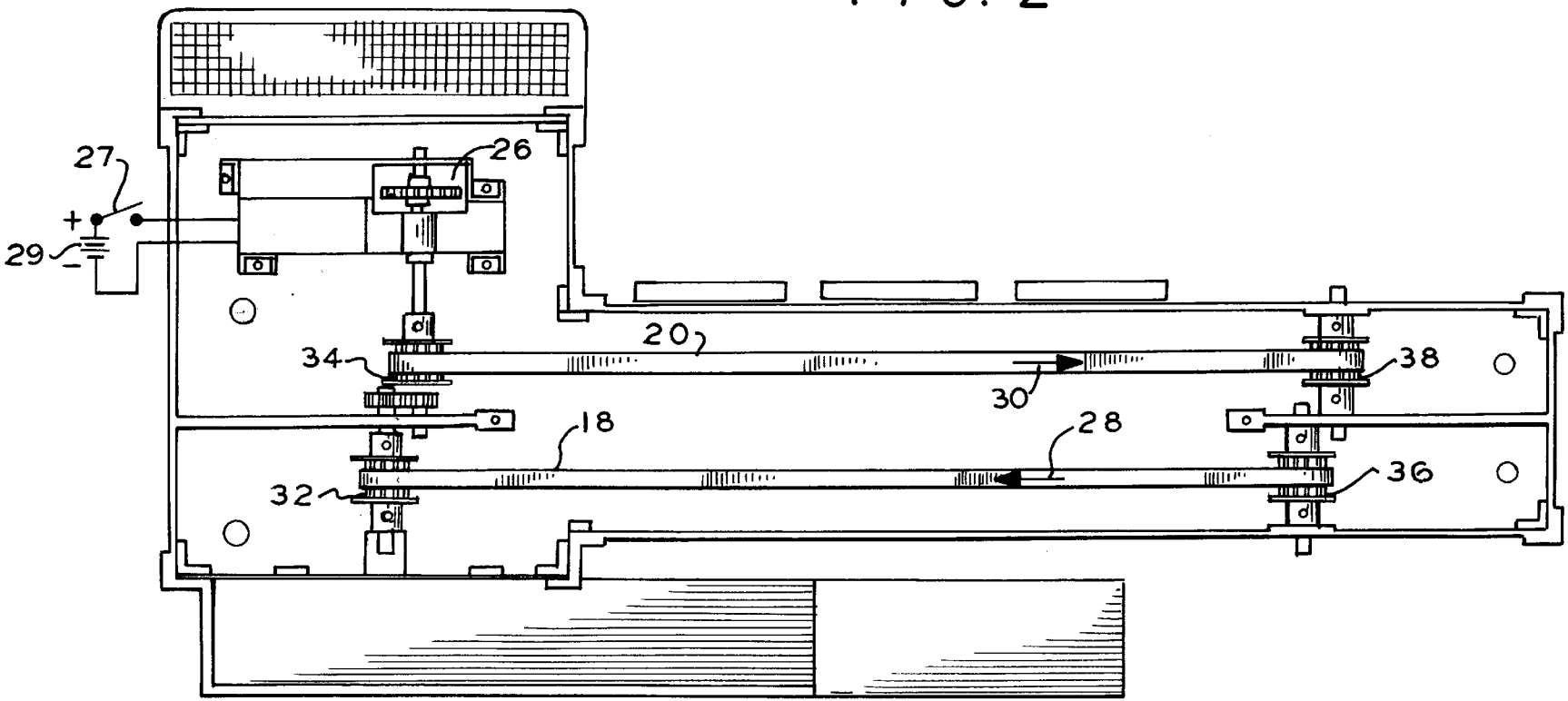
FIG. 2 is a plan view showing the motor and gear mechanism at one end driving the two oppositely moving parallel belts without the figures secured to the belts or the building structures at each end.

As shown in FIG. 2, positioned below building 12 is an electric motor 26 activated by a suitable switch 27 and direct current power source 29 and having a gear drive mechanism connected to belts 18 and 20 to drive the belts in opposite directions, as shown by arrows 28, 30. Suitable roller and support mechanisms 32, 34 engage the opposite ends of the belts 18, 20 at the building end and 36, 38 at the shed end.

Figure 3:
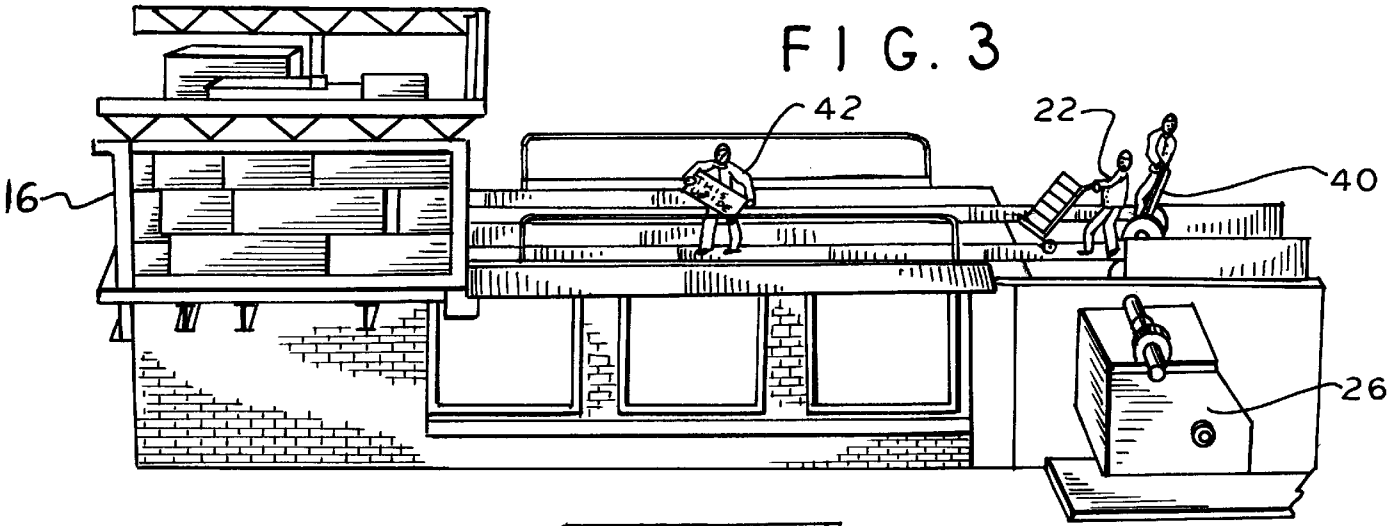
FIG. 3 is an opposite side angled view of the overall device with building and wall portions at one end removed to show movement of the loaded and unloaded figures rotating about one end and along upper belt surfaces in opposite directions.
Figure 4:
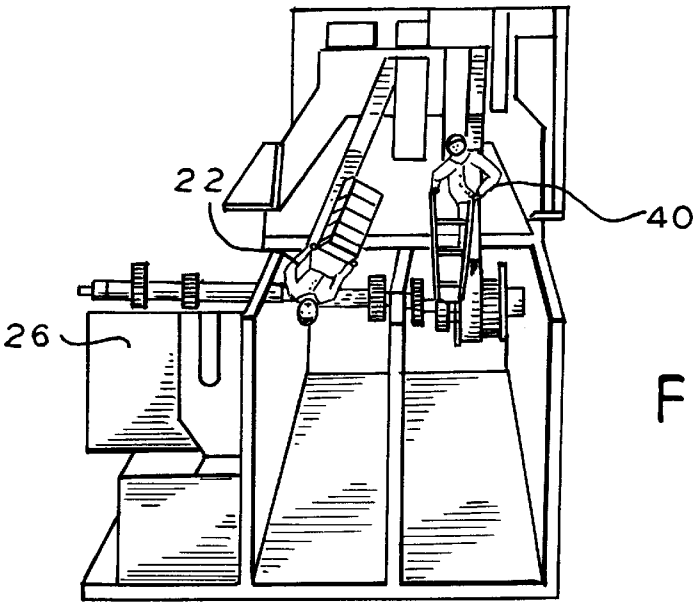
FIG. 4 is an end view of a pair of like figures moving and rotating about the end rollers of each belt in opposite directions.
Figure 5:
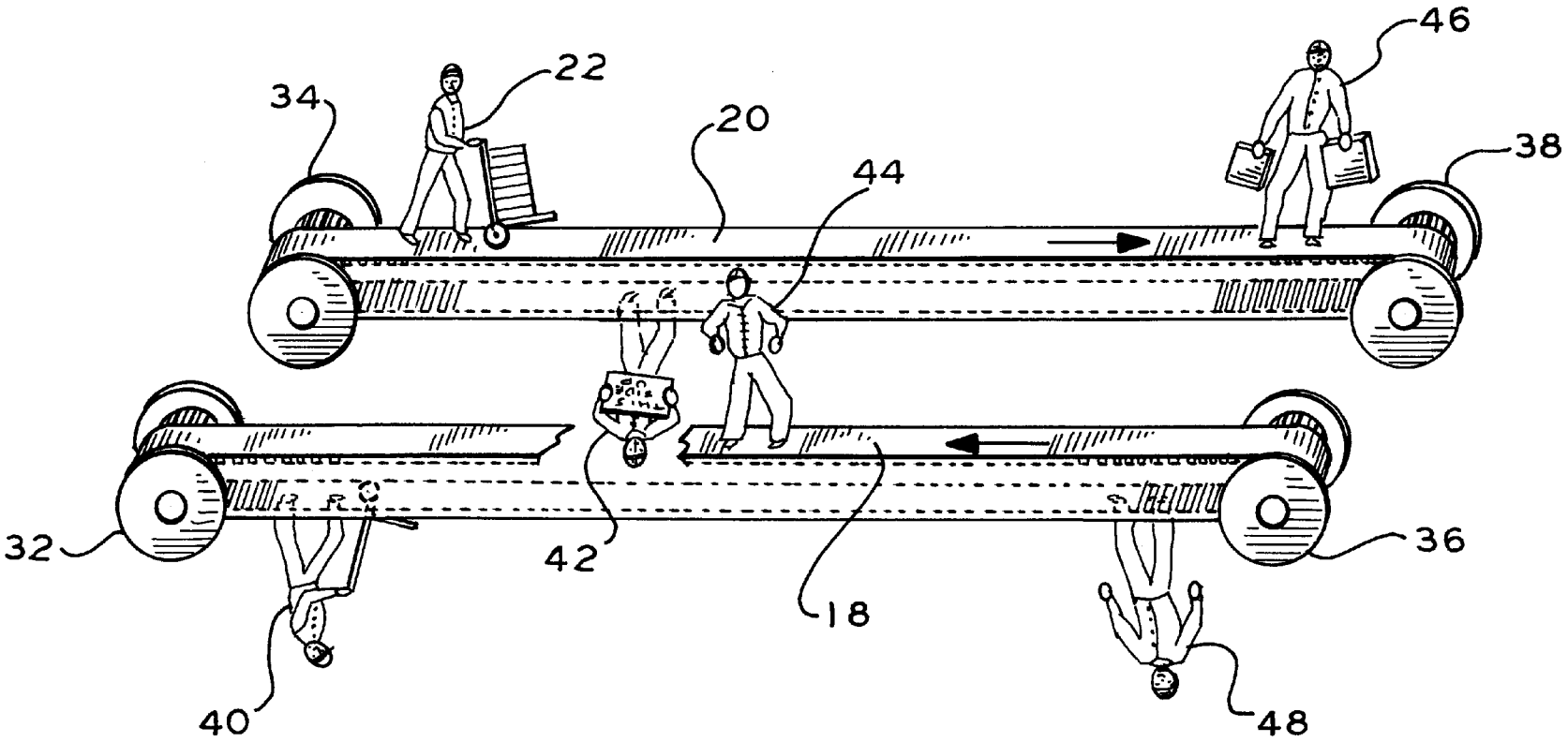
FIG. 5 is a schematic view showing the two parallel belts moving and carrying loaded and unloaded figures in opposite directions along upper and lower surfaces of each belt.

As shown in FIGS. 3, 4 and 5, the figures of workmen are formed in like pairs, such as figure 22 on upper belt 20 shown carrying a load, and figure 40 on lower belt 18 with no load. Similarly, figure 42 is carrying a load along lower belt 20 and like figure 44 on upper belt 18 is not. figure 46 on upper belt 20 is also carrying a load, while like figure 48 on lower belt 18 is not.

The load carrying figures are all secured to belt 20 which is shown having the upper surface moving from the building belt end 34 to the shed belt end 38 while the lower surface returns from end 38 back to end 34. The upright load carrying figures thus move toward the shed but rotate around end 38 within the shed and then return in an inverted position back to building end 34 where they again rotate within the building to an upright position.

The opposite arrangement occurs with all the figures which are not carrying loads. These are all secured to belt 18 having its upper surface moving from the shed end 36 to the building end 32 with the lower surface returning from end 32 to end 36. The upright non load carrying figures thus move toward the building end but rotate around end 32 within the building to return in an inverted position to shed end 36 and again rotate within the shed to an upright position.

The upright load carrying figures are positioned on belt 20 so that as each one enters the shed area which obstructs the view of the rotating belt end, the corresponding twin figure which is not carrying a load, after a short delay emerges upright from the shed along belt 18 to move in the opposite direction back to the building end. This action repeats for each figure in a continuous movement of the belts to provide the illusion that the figures have deposited their loads in the shed and then return empty handed. The respective building, shed and side walls obstruct the view of the rotation of figures at each end and movement of inverted figures along the lower surface of each belt to maintain the desired affect. The same illusion occurs at the building ends of the belt rollers 32, 34 where upright figures without loads enter the building at belt end roller 32 and then shortly appear to exit at end roller 34 carrying a load.

While only a single embodiment has been illustrated and described, other variations may be made in the particular configuration without departing from the scope of the invention as set forth in the appended claims.

What is claimed is:

1. A toy cargo transfer apparatus comprising:

a platform extending between and supported at opposite ends;

building structures positioned at each end;

an electric motor positioned below said platform, a pair of like parallel continuous movable belts disposed along said platform and having rotatable supports at opposite ends of each belt within said building structures, said belts having upper and lower portions movable around said supports;

drive gears coupled between said motor and said rotatable supports at one end of each of said belts, said drive gears and rotatable supports causing respective said belts to move in opposite directions between said building structures at opposite ends; and a plurality of miniature figures secured at spaced intervals along said belts, each belt having duplicate sets of figures to those on the other belt, one of said belts having one set of duplicate figures including items carried by said figures and the other said belt having the other set of duplicate figures without carried items;

actuation of said motor and drive gears causing movement of said one belt with said figures carrying items in one direction toward and into one building and causing movement of the other said belt having said figures without said items out of said one building in the other direction toward and into the other building providing the appearance of the figures having unloaded the items upon movement into and out of said one building.

2. The apparatus of claim 1 wherein each belt has upper surfaces visibly movable along said platform between said supports at opposite ends and rotatable about each end support with lower surfaces of each belt returning below said platform to the opposite end support.

3. The apparatus of claim 2 including side walls extending along said platform between said building structures at each end, said side walls and building structures obstructing the visibility of the lower surfaces of each belt below said platform and the rotatable supports at each belt end.

4. The apparatus of claim 3 wherein the figures on one belt including carried items are visibly movable in one direction along the upper belt surfaces between said building structures at opposite ends and are rotatable about respective said end supports to return invisibly along the lower belt surfaces to the opposite end, and the figures on the other belt without carried items are visibly movable in the opposite direction along the upper belt surfaces between said building structures and are rotatable about the respective end supports of the other belt to return invisibly along the lower belt surfaces of said other belt to the opposite respective end.

5. The apparatus of claim 4 wherein the figures on each belt are secured in an upright position on the upper surfaces of each belt and are in an inverted position along the lower surfaces of each belt.

6. The apparatus of claim 5 wherein the duplicate figures on each belt are positioned so that following the entrance of one duplicate figure with carried items on one belt in one direction into one building, the other of that duplicate figure without said items exits said one building on the other belt in the other direction.

7. The apparatus of claim 6 including a direct current power source and a switch actuating said motor.

* * * * *